US010683871B2

(12) United States Patent
Armstrong

(10) Patent No.: US 10,683,871 B2
(45) Date of Patent: Jun. 16, 2020

(54) FAN BLADE SUPPORT

(71) Applicant: Joseph Cory Armstrong, Nederland, TX (US)

(72) Inventor: Joseph Cory Armstrong, Nederland, TX (US)

( * ) Notice: Subject to any disclaimer, the term of this patent is extended or adjusted under 35 U.S.C. 154(b) by 473 days.

(21) Appl. No.: 15/130,771

(22) Filed: Apr. 15, 2016

(65) Prior Publication Data

US 2016/0305441 A1 Oct. 20, 2016

Related U.S. Application Data

(60) Provisional application No. 62/147,713, filed on Apr. 15, 2015.

(51) Int. Cl.
*F04D 29/34* (2006.01)
*F04D 25/08* (2006.01)

(52) U.S. Cl.
CPC ..... *F04D 29/34* (2013.01); *F04D 25/088* (2013.01)

(58) Field of Classification Search
CPC ..... F04D 29/34; F04D 25/088; F04D 29/38; F04D 29/388
USPC ..... 416/5, 225, 227 R, 233, 238, 240; 248/488, 201
See application file for complete search history.

(56) References Cited

U.S. PATENT DOCUMENTS 1,409,090 A * 3/1922 Glasser ..... F04D 25/105 192/94
4,046,488 A 9/1977 Wickham
5,022,819 A * 6/1991 Murcin ..... A61L 9/122 416/5
5,383,765 A * 1/1995 Baxter ..... A61L 9/12 261/84
5,458,464 A 10/1995 Lee
5,486,094 A 1/1996 Davis, Jr. et al.
5,542,819 A 8/1996 Bucher et al.
5,938,157 A 8/1999 Reiker
5,967,754 A 10/1999 Chou
D417,494 S 12/1999 Evans
6,059,531 A 5/2000 Tai
6,146,097 A 11/2000 Bradt
6,494,682 B1 12/2002 Blateri et al.
D478,980 S 8/2003 Hidalgo
6,613,287 B1 * 9/2003 McElligott ..... A61L 9/042 239/57
D482,773 S 11/2003 Young
6,652,236 B2 * 11/2003 Hai ..... F04D 25/088 416/206
D489,447 S * 5/2004 Young ..... D23/413
6,758,654 B2 7/2004 Liu
6,884,035 B2 4/2005 Young
7,163,377 B2 1/2007 Blateri et al.
D549,818 S 8/2007 Gajewski
7,367,201 B1 5/2008 Doring et al.
8,029,243 B2 * 10/2011 Wang ..... F04D 29/34 416/210 R
8,177,512 B2 5/2012 Mosiewicz
(Continued)

*Primary Examiner* — Kenneth J Hansen
*Assistant Examiner* — Eric J Zamora Alvarez
(74) *Attorney, Agent, or Firm* — Frost Brown Todd LLC

(57) ABSTRACT

A novel fan blade support device is disclosed. The device may be installed on ceiling fan blades to provide support to the blade to prevent sagging and drooping. In another embodiment, the support device may be integrally installed into fan blades to prevent sagging and drooping.

8 Claims, 3 Drawing Sheets

(56) References Cited

U.S. PATENT DOCUMENTS

| | | | |
|---|---|---|---|
| D671,634 | S | 11/2012 | Glasbrenner |
| 8,328,521 | B2 | 12/2012 | Itou et al. |
| 8,393,868 | B2 | 3/2013 | Vettese |
| 8,668,451 | B2 | 3/2014 | Haynes |
| 8,721,305 | B2 | 5/2014 | Oleson et al. |
| 8,770,937 | B2 | 7/2014 | Fizer et al. |
| 8,790,085 | B2 | 7/2014 | Villella |
| 8,851,841 | B2 | 10/2014 | Care |
| 2002/0094273 | A1 | 7/2002 | Huang |
| 2004/0253104 | A1 | 12/2004 | Liu |
| 2012/0014796 | A1 | 1/2012 | Cartwright |
| 2013/0189104 | A1 | 7/2013 | Hollan et al. |

* cited by examiner

FAN BLADE SUPPORT

PRIORITY CLAIM

The present application claims priority to U.S. Provisional Patent Application No. 62/147,713, filed on Apr. 15, 2015.

BACKGROUND

1. Field of the Invention

The present invention relates to an adjustable support for ceiling fan blades which prevents the blades from sagging and drooping.

2. Background

Ceiling fan blades begin to sag or droop downwards over time due to the combined effects of gravity and environmental factors such as moisture and temperature, especially in an outdoor environment. Fan blade replacement may not be easy because replacement blades may need to be matched for configuration and style. Replacement of the entire ceiling fan may incur costs such labor and installation in addition to the cost of the fan itself.

Thus, there is a need in the art for a cost-effective simple device that addresses the issues described above.

SUMMARY OF THE INVENTION

The present invention presents a novel fan blade support device. The device may be installed on ceiling fan blades to provide support to the blade to prevent sagging and drooping. In another embodiment, the support device may be integrally installed into fan blades to prevent sagging and drooping.

BRIEF DESCRIPTION OF THE DRAWINGS

Various aspects and attendant advantages of one or more exemplary embodiments and modifications thereto will become more readily appreciated as the same becomes better understood by reference to the following detailed description, when taken in conjunction with the following drawings.

DETAILED DESCRIPTION OF THE INVENTION

Figure 1A:
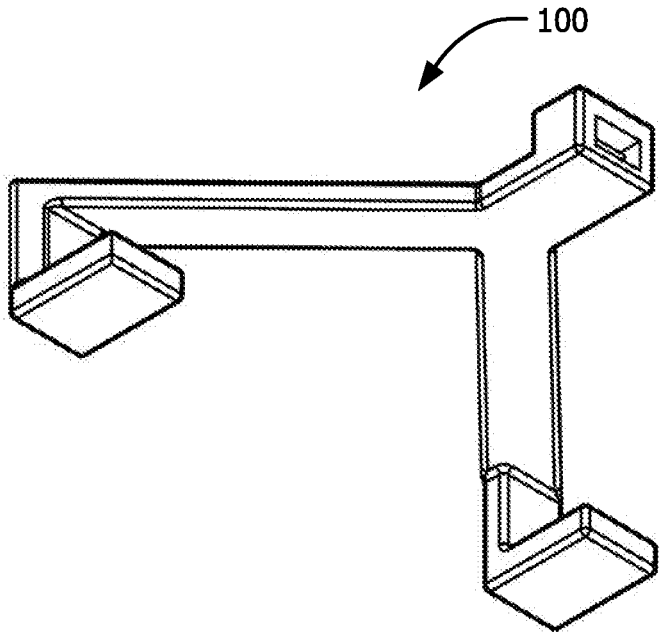
FIGS. 1A and 1B show two angular views of an embodiment of a fan blade support clip.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

As referenced above, ceiling fan blades begin to sag or droop downwards over time due to the combined effects of gravity and environmental factors such as moisture and temperature, especially in an outdoor environment.

Figure 1B:
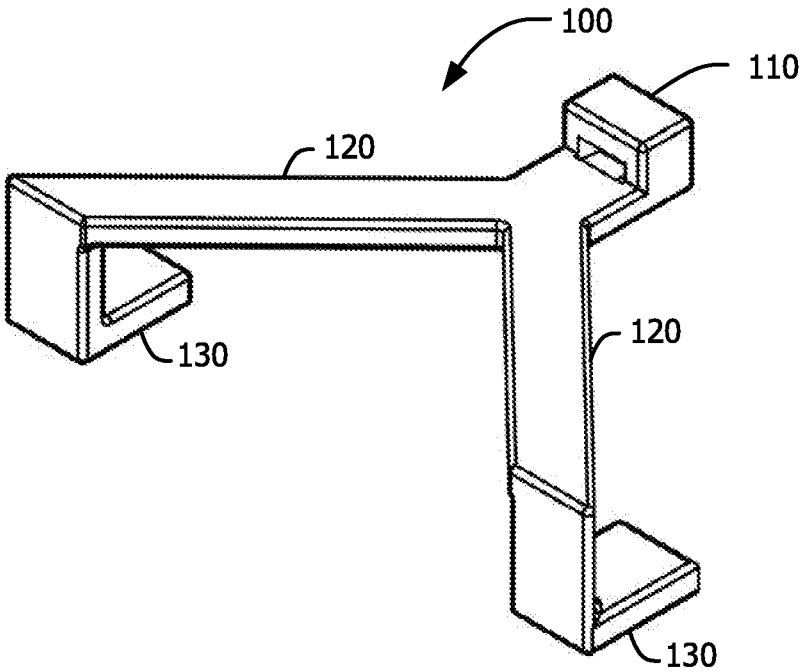

FIGS. 1A and 1B show an embodiment of a fan blade support clip 100 that may be installed to support a fan blade. The embodiment of the fan blade support clip is shown as a Y-shaped clip, although other clip shapes may be used. Two fan blade support clips may be positioned on either end of a fan blade, and they may be connected together by a connecting strap to act as a brace or support for the fan blade. The tension provided by the strap negates the environmental and gravitational effects that would otherwise cause a blade to sag downward.

Referring to FIG. 1B, the Y-shaped clip 100 includes two arms 120 that form a 'Y' shape. As noted above, other shapes may be used, such as a 'U' or a 'V' shape, or the clip may be rectangular or another solid shape. At the end of each arm 120 is a hook 130 that wraps around the end of a fan blade. At the other end of the Y-shaped clip 100 is a female receptacle that may receive a connecting strap. The hooks 130 and/or the Y-clip at vector of 120 may employ hinges or screws to accommodate fan blades of varying thicknesses.

Figure 2B:
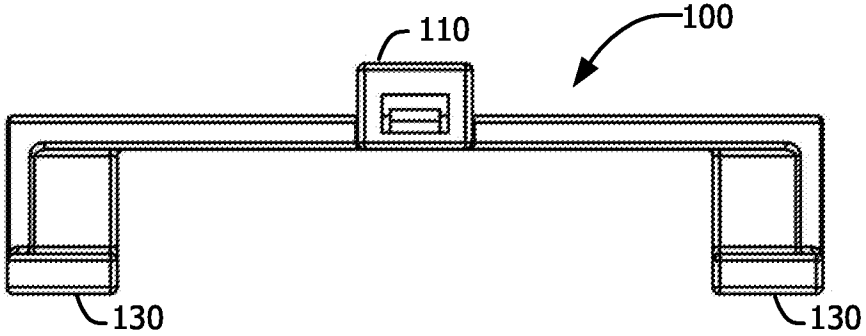
FIGS. 2A-2C show bottom-up, end profile, and side profile views, respectively, of an embodiment of a fan blade support clip.
Figure 2C:
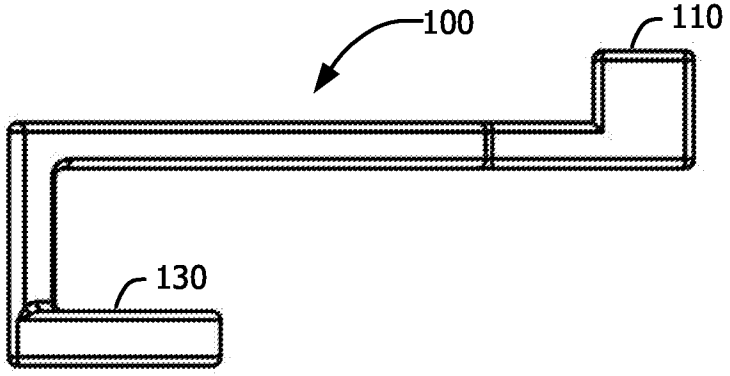
Figure 2A:
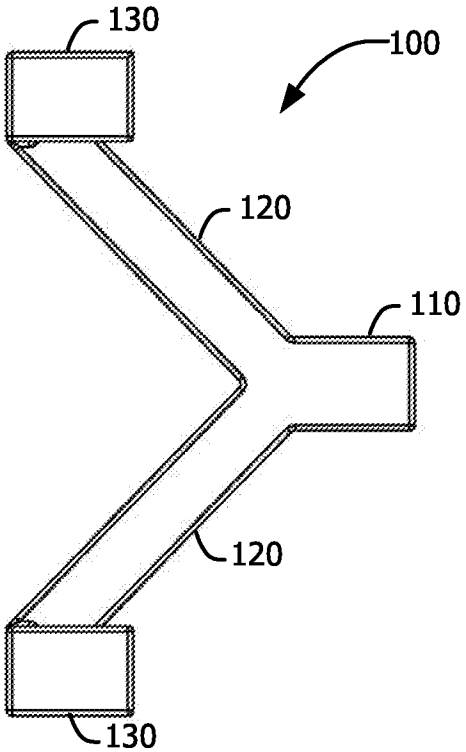

FIG. 2A shows a bottom-up view of the fan blade support clip 100 shown in FIGS. 1A and 1B. FIGS. 2B and 2C show end-profile and side-profile views of the fan blade support clip 100.

Figure 3A:
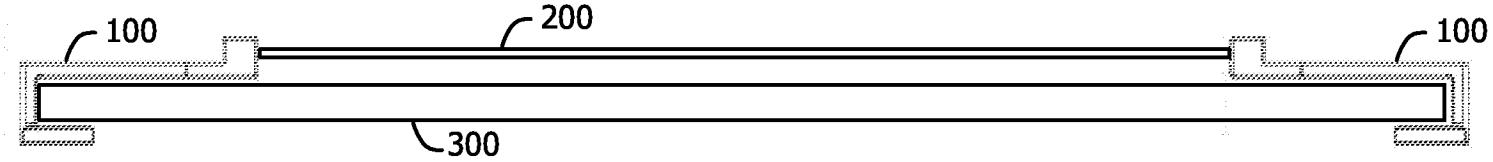
FIGS. 3A and 3B show side profile and top-down views of an embodiment of the fan blade support attached to a fan blade.
Figure 3B:
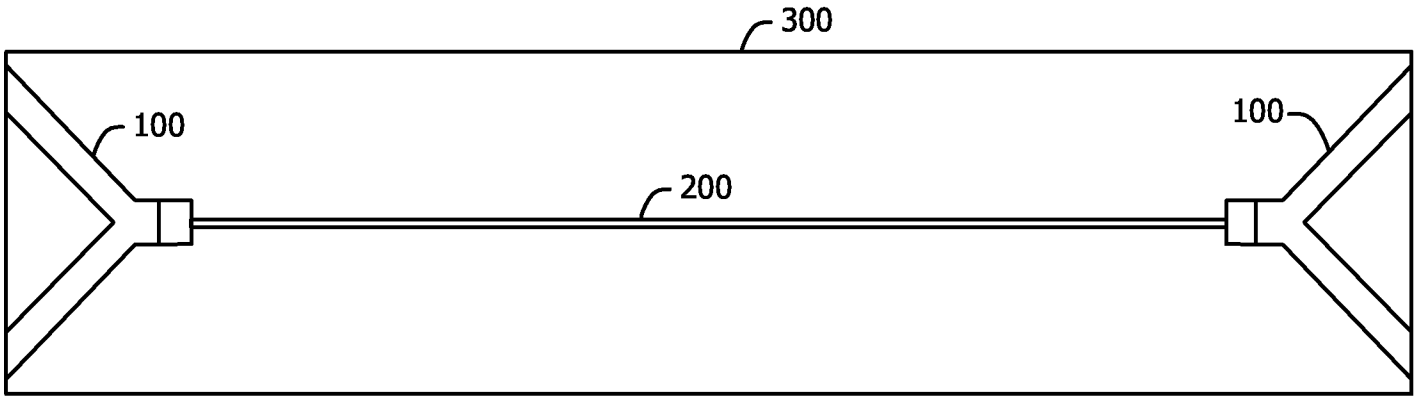

FIGS. 3A and 3B show the fan blade support clips 100 installed on a fan blade 300. The fan blade support clips 100 on either end of the fan blade 300 are held together by connecting strap 200. The connecting strap 200 is secured by passing through the female receptacle 110 in each fan blade support clip 100. During installation, the hooks 130 of the inner fan blade support clip 100 snap over the edge of fan blade 300. The female receptacle 110 of the inner fan blade support clip 100 faces toward the outer edge of the fan blade 300. A second fan blade support clip may be attached on the outer edge of the fan blade 300. The female receptacle 110 of the outer fan blade support clip 100 faces toward the inner edge of the fan blade 300. A strap 200 may be inserted through the female receptacles 110 of both fan blade support clips 100 and pulled tight to create tension between the two fan blade support clips 100. This tension across the length of the fan blade 300 prevents the outer fan blade edges, especially the outer edge, from falling by drooping or sagging.

The connecting strap 200 may be made from a zip tie strap that passes through zip tie female receptacles 110 of the fan blade support clips 100. This would allow tension to be maintained across the connecting strap 200 without requiring the connecting strap 200 to be tied off. Because the strap may be adjustable in length, the fan blade support clips 100 and connecting strap 200 may be used on a variety of blade sizes. The connecting strap 200 may be made from a plastic material such as a but not limited to nylon, ABS, HDPE, LDPE or similar material. It could also be a cable or a solid material like a metal or plastic rod. The end attachments could be made with a screw, clip or other adjustable means.

Although FIGS. 3A and 3B show a rectangularly-shaped fan blade 300, fan blades are often curved for aesthetic appeal. If the fan blade support clip 100 is shaped as the Y-shaped clip shown in the figures, the clip 100 may be centrally positioned around a symmetric curve at either end of the fan blade 300, such that the legs 120 of the Y-shaped clip are positioned on either side of curve peak of the fan blade 300. This allows the fan blade support device to be securely held to the fan blade 300. In an embodiment, the Y-shaped clips could be fabricated using a hinge design at the base of the "Y," such that the legs of the "Y" are pulled together when the assembly is tensioned. As would be appreciated by one of ordinary skill in the art, other designs may be employed for the fan blade support clip 100 to accommodate various fan blade sizes and shapes.

The fan blade support clips 100 could be fabricated out of thin gauge metal, firm plastic, or other non-flexible material. The connecting strap 200 would preferably be a flexible, yet tensile, (horizontally) rigid material such as plastic to fasten to the female receptacles 110 of the fan blade support clip 100. As mentioned above, it could use a "zip tie" design to allow for fastening without requiring tools or needing to be tied off. Excess material on the connecting strap 200 could be left in place or cut off.

In embodiments, different variations could be employed. For example, other materials could be used for connecting straps 200, such as fabric or other flexible materials. Tension could be maintained in the connecting strap 200 by other means, such as adjustable turnbuckle tensioners. In embodiments, the connecting strap 200 could include an elastic material or a spring to help maintain tension along the length of the fan blade 300. In other embodiments, a rigid connecting strap 200 such as a threaded rod could be used along with female threaded receptacles on the fan blade support clip.

While the current embodiment shows the utilization of two clips at either end of the fan blade, other methods may be utilized. In some embodiments, one or both fan blade support clips 100 may not use female receptacles 110. For example, in an embodiment, one fan blade support clip 100 could include an integrally incorporated connecting strap 200, such as a zip tie, that would mate with another fan blade support clip 100 with a female receptacle 110. In an embodiment, a fan blade support clip could be used at the outer end of the fan blade 300 and then other means could be used to attach the strap to the inner portion of the fan blade. This may be done by looping the connecting strap 200 around the fan blade mount, using a fastener to attach the connecting strap 200 at the inner portion of the blade, or using a fastener that mounts on the fan mount to hold the connecting strap 200.

With some fans, the fan blade may be designed such that the fan blade is mounted directly onto a rotating mount on the fan. In such situations, an inner fan blade support may not be appropriate. Instead, an inner supporting member may be used in lieu of a clip and mounted directly onto the rotating portion of the fan mount (for example, above the fan blade mount). The inner supporting member could still employ a female receptacle to receive one end of the connecting strap 200. A similar arrangement may be used when the fan blade is mounted so close to the rotating mount on the fan that it cannot accommodate a fan blade support clip. In another embodiment, the inner supporting member could be mounted around the fan motor shaft.

In other embodiments, a rigid fan blade support could be integrally incorporated into the fan blade. For example, the support could be an internal rigid rod that runs through the fan blade. In such an embodiment, the fan blade could be made out of a different material than that of the internal rigid rod. In embodiments, the fan blade support could be a spine that is externally connected to the fan blade. Likewise, the spine may be manufactured or milled into the fan blade design at production. The external spine could be connected and/or designed above or below the fan blade.

Additionally, the fan blade support clips 100 and connecting strap 200 could be used in other situations. If the hooks 130 of the fan blade support clips 100 fit over an outside edge of any item, the assembly could be used to create inward tension on the outside edges of the item. For example, the assembly could be used across the back of a picture frame to create a tensioned horizontal strap which could be used to hang the frame. In another use, while gluing a square frame together, the assembly could be used to create inward tension on perpendicular sides to maintain hold while the glue dries. The assembly could also be used to permanently or temporarily apply inward tension on any perpendicular surfaces, if the support clips could accommodate the thickness of the perpendicular surfaces.

Although the concepts disclosed herein have been described in connection with the preferred form of practicing them and modifications thereto, those of ordinary skill in the art will understand that many other modifications can be made thereto. Accordingly, it is not intended that the scope of these concepts in any way be limited by the above description. Further it would be understood by those of ordinary skill in the art that features described in relation to one embodiment may be used in addition to, in combination with, or as a replacement for features described in relation to another embodiment.

What is claimed is:

1. A fan blade support, comprising:

a first clip having a first arm and a second arm extending at an angle from a female receptacle, each of the first arm and second arm ending in a first arm hook structure, the first arm hook structure allowing the first clip to be attached to a distal end of a fan blade;

a second clip also having a first arm and a second arm extending at an angle from a female receptacle, each of the first arm and second arm ending in a second arm hook structure, the second arm hook structure allowing the second clip to be attached to a proximate end of the fan blade, wherein the female receptacles of the first clip and the second clip are positioned in a plane above the fan blade; and a connecting strap connecting the first and second clips using the female receptacles of the first clip and the second clip, wherein the positioning of the female receptacles of the first clip and the second clip places the connecting strap above the fan blade, the connecting strap is parallel to and spaced apart from the fan blade thereby creating tension between the first clip and the second clip.

2. The fan blade support according to claim 1, wherein a first end of the connecting strap passes through the female receptacle of the first clip and a second end of the connecting strap passes through the female receptacle of the second clip.

3. The fan blade support according to claim 2, wherein the connecting strap comprises a zip tie.

4. The fan blade support according to claim 1, wherein the first clip is a Y-shaped clip.

5. A method of supporting a fan blade, comprising:

attaching a first clip to a distal end of a fan blade, the first clip having a first arm and a second arm extending at an angle from a female receptacle, each of the first arm and second arm ending in a first arm hook structure, the first arm hook structure securing the first clip to the distal end of a fan blade;

attaching a second clip to a proximate end of the fan blade, the second clip also having a first arm and a second arm extending at an angle from a female receptacle, each of the first arm and second arm ending in a second arm hook structure, wherein the female receptacles of the first clip and the second clip are positioned in a plane above the fan blade; and connecting the first clip and second clip with a connecting strap by using the female receptacles of the first clip and the second clip, wherein the female receptacles of the first clip and the second clip position the connecting strap above the fan blade, the connecting strap is parallel to and spaced apart from the fan blade thereby creating tension between the first clip and the second clip.

6. The method according to claim 5, wherein a first end of the connecting strap passes through the female receptacle of the first clip and a second end of the connecting strap passes through the female receptacle of the second clip.

7. The method according to claim 5, wherein the connecting strap comprises a zip tie material.

8. The method according to claim 5, wherein the first clip is a Y-shaped clip.

* * * * *